US008928642B2

(12) United States Patent
Chung

(10) Patent No.: US 8,928,642 B2
(45) Date of Patent: Jan. 6, 2015

(54) PIXEL AND ORGANIC LIGHT EMITTING DISPLAY DEVICE USING THE SAME

(75) Inventor: Bo-Yong Chung, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 665 days.

(21) Appl. No.: 12/889,334

(22) Filed: Sep. 23, 2010

(65) Prior Publication Data

US 2011/0199358 A1 Aug. 18, 2011

(30) Foreign Application Priority Data

Feb. 17, 2010 (KR) ..... 10-2010-0014112

(51) Int. Cl.
*G09G 5/00* (2006.01)
*G09G 3/32* (2006.01)

(52) U.S. Cl.
CPC ..... *G09G 3/3233* (2013.01); *G09G 2300/0819* (2013.01); *G09G 2300/0842* (2013.01); *G09G 2300/0861* (2013.01); *G09G 2320/043* (2013.01)
USPC ..... 345/211

(58) Field of Classification Search
CPC ..... G09G 3/3233; G09G 2300/0819; G09G 2320/043; G09G 2310/0262; G09G 2320/0233; G09G 2320/0252; G09G 5/00
USPC ..... 345/211
See application file for complete search history.

(56) References Cited

U.S. PATENT DOCUMENTS

2005/0093787 A1* 5/2005 Kim et al. ..... 345/76
2006/0066532 A1* 3/2006 Jeong ..... 345/76
2006/0077194 A1* 4/2006 Jeong ..... 345/204
2006/0139259 A1* 6/2006 Choi et al. ..... 345/76
2006/0151745 A1* 7/2006 Kim et al. ..... 252/301.16

(Continued)

FOREIGN PATENT DOCUMENTS

JP 2005-189383 7/2005
JP 2009-139820 6/2009
KR 1020060031545 A 4/2006

OTHER PUBLICATIONS

KIPO Office action dated Aug. 25, 2011, for Korean priority Patent application 10-2010-0014112, noting reference previously submitted in an IDS dated Aug. 8, 2011, 1 page.

(Continued)

*Primary Examiner* — Joe H Cheng
*Assistant Examiner* — Michael J Jansen, II
(74) *Attorney, Agent, or Firm* — Christie, Parker & Hale, LLP

(57) ABSTRACT

A pixel and an organic light emitting display device using the same are provided. The pixel includes an organic light emitting diode. A first transistor has a second electrode coupled to the organic light emitting diode, and controls the amount of current supplied to the organic light emitting diode. A third transistor is coupled between a reference power source and a first node, and is turned on when a scan signal is supplied to a scan line. A second transistor is turned on when the scan signal is supplied to the scan line, and electrically couples a data line to a second node. A fourth transistor is coupled between the first and second nodes, and is turned off when an emission control signal is supplied to an emission control line. A storage capacitor is coupled between the second node and a first electrode of the first transistor.

9 Claims, 4 Drawing Sheets

(56) References Cited

U.S. PATENT DOCUMENTS

| | | | | |
|---|---|---|---|---|
| 2006/0262130 | A1* | 11/2006 | Kim et al. | 345/589 |
| 2007/0040772 | A1* | 2/2007 | Kim | 345/76 |
| 2007/0279345 | A1* | 12/2007 | Kim | 345/80 |
| 2008/0035931 | A1* | 2/2008 | Kwak et al. | 257/72 |
| 2008/0074360 | A1* | 3/2008 | Lu et al. | 345/77 |
| 2009/0146987 | A1* | 6/2009 | Kim et al. | 345/212 |
| 2009/0309516 | A1* | 12/2009 | Kim | 315/307 |
| 2009/0309816 | A1* | 12/2009 | Choi | 345/76 |
| 2010/0020059 | A1* | 1/2010 | Suh | 345/212 |
| 2010/0141645 | A1* | 6/2010 | Choi et al. | 345/214 |
| 2010/0156762 | A1* | 6/2010 | Choi | 345/76 |
| 2010/0220038 | A1* | 9/2010 | Chung et al. | 345/76 |
| 2010/0220040 | A1* | 9/2010 | Kwak et al. | 345/76 |
| 2010/0309187 | A1* | 12/2010 | Kang et al. | 345/211 |

OTHER PUBLICATIONS

KR Office Action dated Jun. 22, 2011 issued in Korean Application No. 10-2010-0014112, 4 pages.

* cited by examiner

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2010-0014112, filed on Feb. 17, 2010, in the Korean Intellectual Property Office, the entire content of which is incorporated herein by reference.

BACKGROUND

1. Field

An aspect according to embodiments of the present invention relates to a pixel and an organic light emitting display device using the same.

2. Description of Related Art

Recently, there have been developed various types of flat panel display devices having reduced weight and volume to address disadvantages of cathode ray tubes. The flat panel display devices include a liquid crystal display device, a field emission display device, a plasma display panel, an organic light emitting display device, and the like.

Among these flat panel display devices, the organic light emitting display device displays images using organic light emitting diodes that emit light through the recombination of electrons and holes.

FIG. 1 is a circuit diagram of a related art pixel of an organic light emitting display device.

Referring to FIG. 1, a pixel 4 of the organic light emitting display device includes an organic light emitting diode (OLED) and a pixel circuit 2 coupled to a data line Dm and a scan line Sn to control the OLED.

An anode electrode of the OLED is coupled to the pixel circuit 2, and a cathode electrode of the OLED is coupled to a second power source ELVSS. The OLED is configured to generate light with a predetermined luminance corresponding to a current supplied from the pixel circuit 2.

When a scan signal is supplied to the scan line Sn, the pixel circuit 2 is configured to control an amount of current supplied to the OLED in response to a data signal supplied to the data line Dm. The pixel circuit 2 includes a second transistor M2" coupled between a first power source ELVDD and the OLED; a first transistor M1" coupled between the second transistor M2" and the data and scan lines Dm and Sn; and a storage capacitor Cst" coupled between a gate electrode and a first electrode of the second transistor M2".

A gate electrode of the first transistor M1" is coupled to the scan line Sn, and a first electrode of the first transistor M1" is coupled to the data line Dm. A second electrode of the first transistor M1" is coupled to one terminal of the storage capacitor Cst". Here, the first electrode is a source electrode or a drain electrode, and the second electrode is the other one of the source and drain electrodes. For example, when the first electrode is the source electrode, the second electrode is the drain electrode, and vice versa. When a scan signal is supplied from the scan line Sn, the first transistor M1" coupled to the scan and data lines Sn and Dm is turned on in order to supply a data signal supplied from the data line Dm to the storage capacitor Cst". At this time, a voltage corresponding to a voltage of the data signal is charged into the storage capacitor Cst".

The gate electrode of the second transistor M2" is coupled to the one terminal of the storage capacitor Cst", and the first electrode of the second transistor M2" is coupled to the other terminal of the storage capacitor Cst" and the first power source ELVDD. A second electrode of the second transistor M2" is coupled to an anode electrode of the OLED. The second transistor M2" controls an amount of current that flows from the first power source ELVDD to a second power source ELVSS via the OLED in accordance with the voltage stored in the storage capacitor Cst".

However, the pixel 4 of the organic light emitting display device may not display images with uniform luminescence. More specifically, threshold voltages of second transistors M2", also referred to as drive transistors, included in the respective pixels 4 may be different from one another due to process variations and the like. When the threshold voltages of the drive transistors are different from one another, rays with different luminances are produced by differences in threshold voltages between the drive transistors, although a data signal corresponding to the same gray level is supplied to the plurality of pixels 4.

The organic light emitting display device has a fast response speed and is driven with low power consumption. However, because transistors in the organic light emitting display device may not be uniform, non-uniform pixel luminescence may result. Therefore, research on ways to achieve more uniform luminescence is ongoing.

SUMMARY

Accordingly, an aspect of the present invention provides a pixel capable of displaying images with uniform luminance and an organic light emitting display device using the same.

In order to achieve the foregoing and/or other aspects of the present invention, according to one embodiment of the present invention, there is provided a pixel including: an organic light emitting diode; a first transistor having a second electrode coupled to the organic light emitting diode, the first transistor being configured to control an amount of current supplied to the organic light emitting diode; a third transistor coupled between a reference power source and a first node, the first node being coupled to a gate electrode of the first transistor, the third transistor being configured to be turned on when a scan signal is supplied to a scan line; a second transistor configured to be turned on when the scan signal is supplied to the scan line, the second transistor for electrically coupling a data line and a second node to each other; a fourth transistor coupled between the first node and the second node, the fourth transistor being configured to be turned off when an emission control signal is supplied to an emission control line; and a storage capacitor coupled between the second node and a first electrode of the first transistor.

The pixel may further include a fifth transistor coupled between the first electrode of the first transistor and a first power source, the fifth transistor may be configured to be turned off when the emission control signal is supplied to the emission control line. A turn-on time of the second transistor and a turn-on time of the fourth transistor may partially overlap one another in time. The fourth transistor may be configured to be turned off after the second transistor is turned on, and the fourth transistor may be configured to be turned on after the second transistor is turned off.

According to another embodiment of the present invention, there is provided a pixel including: an organic light emitting diode; a first transistor having a second electrode coupled to the organic light emitting diode and having a gate electrode coupled to a first node, the first transistor being configured to control an amount of current supplied to the organic light emitting diode; a third transistor coupled between a data line and the first node, the third transistor being configured to be turned on when a scan signal is supplied to a scan line; a second transistor coupled between a reference power source and a second node, the second transistor being configured to be turned on when the scan signal is supplied to the scan line; a fourth transistor coupled between the first node and the second node, the fourth transistor being configured to be turned off when an emission control signal is supplied to an emission control line; and a storage capacitor coupled between the second node and a first electrode of the first transistor.

The pixel may further include a fifth transistor coupled between the first electrode of the first transistor and a first power source, and the fifth transistor may be configured to be turned off when the emission control signal is supplied to the emission control line. A turn-on time of the second transistor and a turn-on time of the fourth transistor may partially overlap one another in time. The fourth transistor may be configured to be turned off after the second transistor is turned on, and the fourth transistor may be configured to be turned on after the second transistor is turned off.

According to yet another embodiment of the present invention, there is provided an organic light emitting display device including: a scan driver configured to supply a scan signal to scan lines and to supply an emission control signal to emission control lines; a data driver configured to supply a data signal to data lines; and pixels positioned at crossing regions of the scan lines and the data lines, wherein each of the pixels includes: an organic light emitting diode; a first transistor having a second electrode coupled to the organic light emitting diode, the first transistor being configured to control an amount of current supplied to the organic light emitting diode; a third transistor configured to be turned on when the scan signal is supplied to a corresponding scan line of the scan lines, the third transistor for electrically coupling a first node coupled to a gate electrode of the first transistor to a reference power source or to a corresponding data line of the data lines; a second transistor configured to be turned on when the scan signal is supplied to the corresponding scan line, the second transistor for electrically coupling a second node to the corresponding data line or to the reference power source; a fourth transistor coupled between the first node and the second node, the fourth transistor being configured to be turned off when the emission control signal is supplied to a corresponding emission control line of the emission control lines; and a storage capacitor coupled between the second node and a first electrode of the first transistor.

The third transistor may be coupled between the reference power source and the first node, and the second transistor may be coupled between the corresponding data line and the second node. The third transistor may be coupled between the corresponding data line and the first node, and the second transistor may be coupled between the reference power source and the second node. Each of the pixels may further include a fifth transistor coupled between the first electrode of the first transistor and a first power source, and the fifth transistor may be configured to be turned off when the emission control signal is supplied to the corresponding emission control line. The reference power source may be configured to have a voltage between a first data signal of a black gray level and a second data signal of a white gray level. The scan driver may be configured to supply the emission control signal to the corresponding emission control line so that the emission control signal overlaps in time with the scan signal supplied to the corresponding scan line during a first period. The scan driver may be configured to supply the emission control signal to the corresponding emission control line after the scan signal is supplied to the corresponding scan line. The scan driver may be configured to stop the supply of the emission control signal to the corresponding emission control line after the supply of the scan signal to the corresponding scan line is stopped. The data driver may be configured to supply the data signal to the corresponding data line during a second period in which the scan signal overlaps the emission control signal in time.

In a pixel and an organic light emitting display device using the same according to embodiments of the present invention, because each pixel includes five transistors and is coupled to three signal lines, its yield, aperture ratio and reliability can be improved. Further, an image with a desired luminance can be displayed regardless of the threshold voltage of a drive transistor and the voltage drop of a first power. Furthermore, gray levels can be represented by applying a data signal with a low voltage of about 0V to about 5V (e.g. 0V to 5V).

BRIEF DESCRIPTION OF THE DRAWINGS

The accompanying drawings, together with the specification, illustrate exemplary embodiments of the present invention, and, together with the description, serve to explain the principles of embodiments of the present invention.

DETAILED DESCRIPTION

Figure 1:
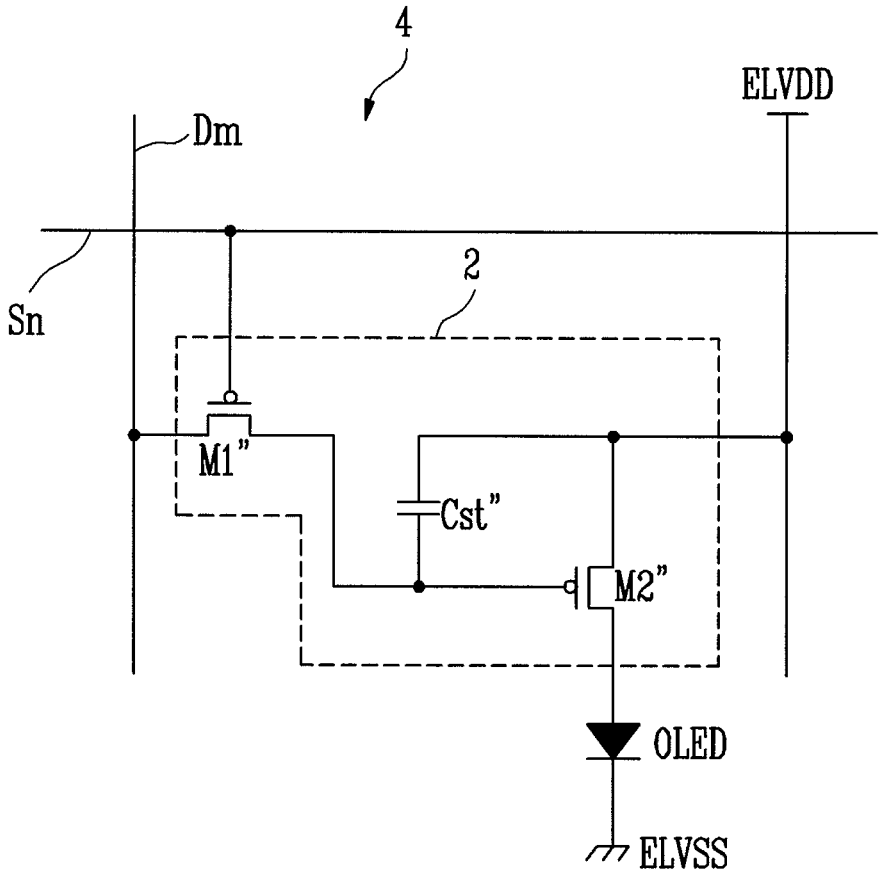
FIG. 1 (Related Art)
FIG. 1 is a circuit diagram of a related art pixel.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to a complete understanding of the invention are omitted for clarity. Also, like reference numerals refer to like elements throughout.

A structure in which transistors are additionally formed to compensate for the threshold voltage of the drive transistor in each of the pixels may improve the uniformity of pixel luminescence. A structure in which six or more transistors are included in each of the pixels so as to compensate for the threshold voltage of the drive transistor has been suggested. However, when six transistors are included in each of the pixels 4, a yield is deteriorated. Also, since such pixels might be coupled to four signal lines, an aperture ration is decreased, and design is complicated.

Hereinafter, exemplary embodiments of the present invention are described in detail with reference to FIGS. 2 to 6.

Figure 2:
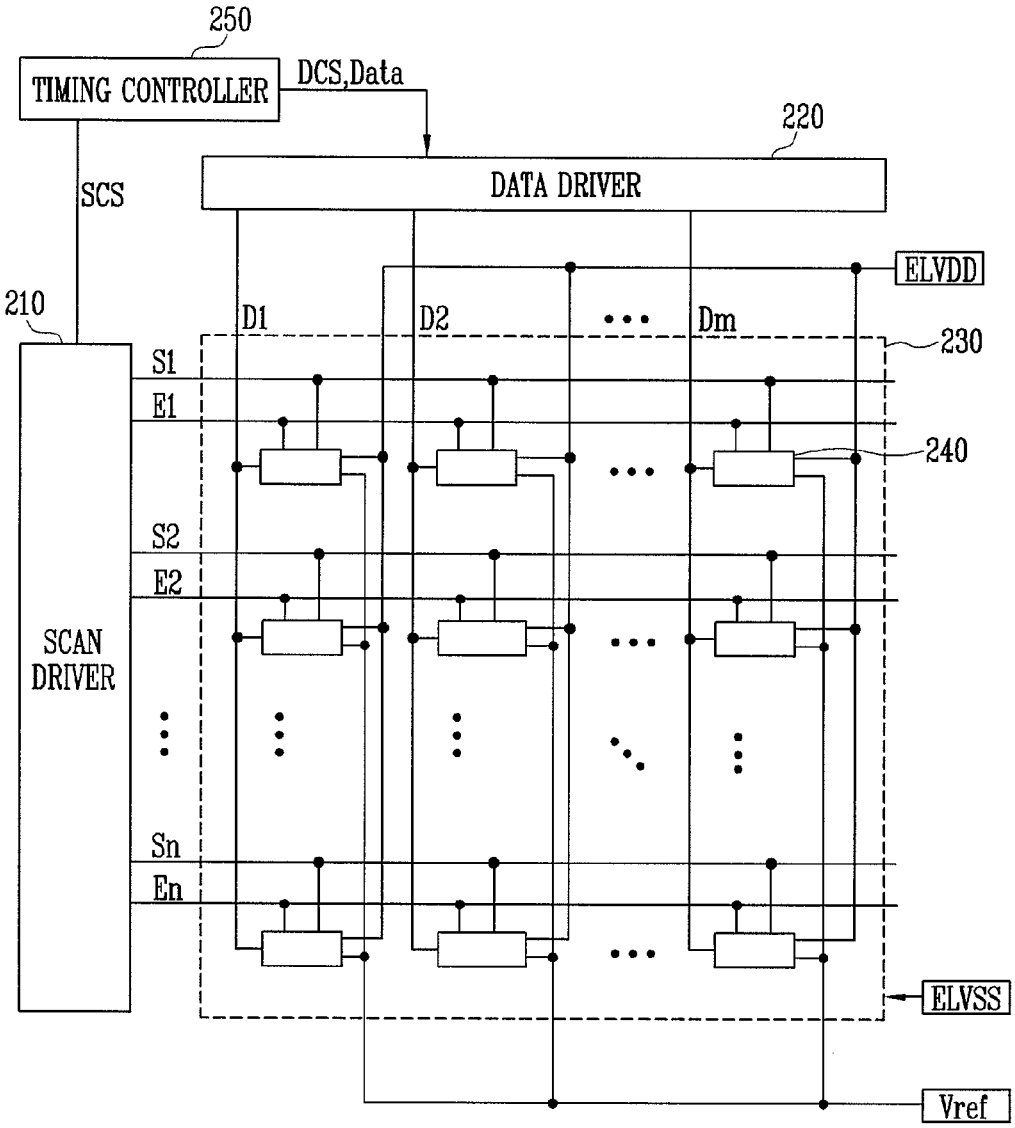
FIG. 2 is a block diagram of an organic light emitting display device according to an embodiment of the present invention.

FIG. 2 is a block diagram of an organic light emitting display device according to an embodiment of the present invention.

Referring to FIG. 2, the organic light emitting display device according to one embodiment of the present invention includes a display unit 230 having pixels 240 coupled to scan lines S1 to Sn, emission control lines E1 to En, and data lines D1 to Dm; a scan driver 210 for driving the scan lines S1 to Sn and the emission control lines E1 to En; a data driver 220 for driving the data lines D1 to Dm; and a timing controller 250 for controlling the scan driver 210 and the data driver 220.

The scan driver 210 receives a scan drive control signal SCS supplied from the timing controller 250. The scan driver 210 then generates a scan signal and sequentially supplies the generated scan signal to the scan lines S1 to Sn. The scan driver 210 that receives the scan drive control signal SCS supplied from the timing controller 250 generates an emission control signal and sequentially supplies the generated emission control signal to the emission control lines E1 to En.

Here, the emission control signal supplied to an $i^{th}$ ("i" is a positive integer) emission control line Ei is supplied to overlap with the scan signal supplied to an $i^{th}$ scan line Si during a partial period (e.g., a first period). In practice, after the scan signal is supplied to the $i^{th}$ scan line Si, the emission control signal is supplied to the $i^{th}$ emission control line Ei. After the supply of the scan signal to the $i^{th}$ scan line Si is stopped, the supply of the emission control signal to the $i^{th}$ emission line Ei is stopped. In the described embodiment, the scan signal is set to have a voltage (e.g., a low voltage) at which a transistor included in each of the pixels 240 can be turned on, and the emission control signal is set to have a voltage (e.g., a high voltage) at which the transistor included in each of the pixels 240 can be turned off.

The data driver 220 receives a data drive control signal DCS supplied from the timing controller 250. The data driver 220 then generates data signals and supplies respective data signals to data lines D1 to Dm. Here, the data signal is supplied during a period in which the scan signal and the emission control signal overlap with each other.

The timing controller 250 generates the data drive control signal DCS and the scan drive control signal SCS in response to externally supplied synchronization signals. The data drive control signal DCS generated from the timing controller 250 is supplied to the data driver 220, and the scan drive control signal SCS generated from the timing controller 250 is supplied to the scan driver 210. The timing controller 250 supplies externally supplied data Data to the data driver 220.

The display unit 230 receives a first power from a first power source ELVDD, a second power from a second power source ELVSS, and a reference power from a reference power source Vref, and supplies them to each of the pixels 240. Each of the pixels 240 that receives the first power from the first power source ELVDD, the second power from the second power source ELVSS, and the reference power from the reference power source Vref emits light (e.g., with a predetermined luminance) while controlling an amount of current that flows from the first power source ELVDD to the second power source ELVSS via an OLED corresponding to a difference of the voltages between the data signal and the reference power from the reference power source Vref. Here, the reference power source Vref is set to have a voltage that is lower than that of a data signal of a black gray level and is higher than that of a data signal of a white gray level.

Figure 3:
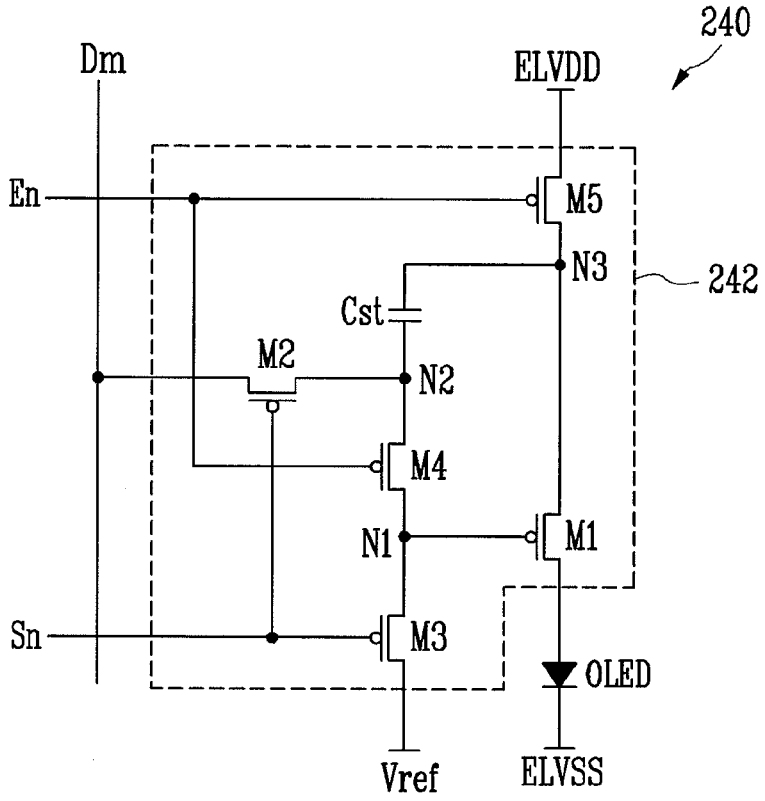
FIG. 3 is a circuit diagram showing an embodiment of a pixel shown in FIG. 2.

FIG. 3 is a circuit diagram showing one embodiment of the pixel shown in FIG. 2. For convenience of illustration, the pixel 240 coupled to an $n^{th}$ scan line Sn and an $m^{th}$ data line Dm is shown (n and m are positive integers).

Referring to FIG. 3, the pixel 240 according to one embodiment of the present invention includes an OLED and a pixel circuit 242 coupled to the data line Dm, the scan line Sn, and the emission control line En, so as to control the amount of current supplied to the OLED.

An anode electrode of the OLED is coupled to the pixel circuit 242, and a cathode electrode of the OLED is coupled to the second power source ELVSS. The OLED generates light (e.g., with a predetermined luminance) corresponding to current supplied from the pixel circuit 242.

The pixel circuit 242 controls the amount of current supplied from the first power source ELVDD to the second power source ELVSS via the OLED in response to a data signal. To this end, the pixel circuit 242 includes first to fifth transistors M1 to M5 and a storage capacitor Cst.

A gate electrode of the first transistor M1 is coupled to a first node N1, and a first electrode of the first transistor M1 is coupled to a third node N3. A second electrode of the first transistor M1 is coupled to the anode electrode of the OLED. The first transistor M1 controls the amount of current supplied to the OLED corresponding to a voltage charged in the storage capacitor Cst.

A gate electrode of the second transistor M2 is coupled to the scan line Sn, and a first electrode of the second transistor M2 is coupled to the data line Dm. A second electrode of the second transistor M2 is coupled to a second node N2. When a scan signal is supplied to the $n^{th}$ scan line Sn, the second transistor M2 is turned on to supply a data signal supplied from the data line Dm to the second node N2.

A gate electrode of the third transistor M3 is coupled to the scan line Sn, and a first electrode of the third transistor M3 is coupled to the first node N1. A second electrode of the third transistor M3 is coupled to the reference power source Vref. When the scan signal is supplied to the scan line Sn, the third transistor M3 is turned on to supply the voltage of the reference power source Vref to the first node N1.

A gate electrode of the fourth transistor M4 is coupled to the emission control line En, and a first electrode of the fourth transistor M4 is coupled to the second node N2. A second electrode of the fourth transistor M4 is coupled to the first node N1. When no emission control signal is supplied to the emission control line En, the fourth transistor M4 is turned on, and electrically couples the first and second nodes N1 and N2 to each other.

A gate electrode of the fifth transistor M5 is coupled to the emission control line En, and a first electrode of the fifth transistor M5 is coupled to the first power source ELVDD. A second electrode of the fifth transistor M5 is coupled to the third node N3. When no emission control signal is supplied to the emission control line En, the fifth transistor M5 is turned on to supply the voltage of the first power source ELVDD to the third node N3.

The storage capacitor Cst is coupled between the second and third nodes N2 and N3. A voltage corresponding to the threshold voltage of the first transistor M1 and the voltage of the data signal is charged across the storage capacitor Cst.

Figure 4:
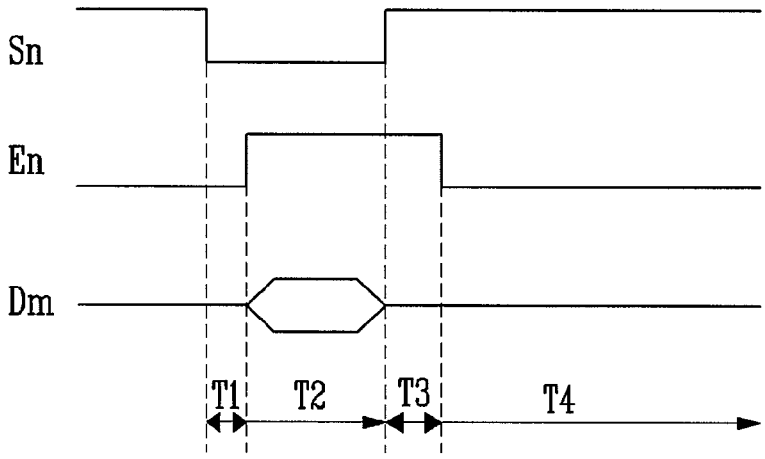
FIG. 4 is a waveform diagram illustrating a driving method of the embodiment of the pixel shown in FIG. 3.

FIG. 4 is a waveform diagram illustrating a driving method of the pixel 240 shown in FIG. 3.

Referring to FIG. 4, a scan signal is first supplied to the scan line Sn during a first period T1. When the scan signal is supplied to the scan line Sn, the second and third transistors M2 and M3 are turned on. Since no emission control signal is supplied to the emission control line En during the first period T1, the fourth and fifth transistors M4 and M5 maintain a turned-on state.

When the third transistor M3 is turned on, the voltage of the reference power source Vref is supplied to the first node N1, and the second node N2 is electrically coupled to the first node N1. When the second transistor M2 is turned on, the data line Dm and the second node N2 are electrically coupled to each other. At this time, no data signal is supplied to the data line Dm. Therefore, the voltage of the reference power source Vref is maintained at the second node N2. The first period T1 is used as an initialization period in which the voltage at each of the first and second nodes N1 and N2 is changed into the voltage of the reference power source Vref. Meanwhile, the data line Dm may be set in a high impedance state during the first period T1 so that the voltage at the second node N2 is maintained as the voltage of the reference power source Vref.

During a second period T2, an emission control signal is supplied to the emission control line En. When the emission control signal is supplied to the emission control line En, the fourth and fifth transistors M4 and M5 are turned off. During the second period T2, a data signal is supplied to the data line Dm.

When the fourth transistor M4 is turned off, the first and second nodes N1 and N2 are electrically isolated from each other. At this time, the voltage of the reference power source Vref is supplied to the first node N1, and a voltage Vdata of the data signal is supplied to the second node N2.

When the fifth transistor M5 is turned off, the first power source ELVDD and the third node N3 are electrically isolated from each other. When the third node N3 is electrically isolated from the first power source ELVDD, the voltage at the third node N3 is gradually dropped from the voltage of the first power source ELVDD. At this time, the voltage at the first node N1 is set as that of the reference power source Vref. Therefore, the voltage at the third node N3 is dropped to the voltage obtained by adding the threshold voltage of the first transistor M1 to the voltage of the reference power source Vref. A voltage corresponding to a difference of voltages between the second and third nodes N2 and N3 is charged in the storage capacitor Cst during the second period T2. That is, the voltage corresponding to the threshold voltage of the first transistor M1 and the voltage of the data signal is charged across the storage capacitor Cst.

Here, the voltage of the reference power source Vref is set as a voltage between a data signal of a black gray level and a data signal of a white gray level. More specifically, the voltage at the second node N2 is changed from the voltage of the reference power source Vref to the voltage Vdata of the data signal. When the data signal of the black gray level is supplied at the voltage of the reference power source Vref, the voltage at the second node N2 is raised from the voltage of the reference power source Vref to the voltage Vdata of the data signal of the black gray level, and accordingly, the first transistor M1 can be stably turned off. When the data signal of the white gray level is supplied at the voltage of the reference power source Vref, the voltage at the second node N2 is dropped from the voltage of the reference power source Vref to the voltage Vdata of the data signal of the white gray level, and accordingly, the channel width of the first transistor M1 can be controlled so that current corresponding to the white gray level flows in the OLED. Meanwhile, the gray levels, except the white gray level, are displayed while controlling the channel width of the first transistor M1 in the range of the voltages between the reference power source Vref and the data signal of the white gray level.

The supply of the scan signal to the scan line Sn is stopped during a third period T3. When the supply of the scan signal to the scan line Sn is stopped, the second and third transistors M2 and M3 are turned off. At this time, the voltage maintained during the second period T2 is maintained at the first, second, and third nodes N1, N2 and N3.

The supply of the emission control signal to the emission control line is stopped during a fourth period T4. When the supply of the emission control signal to the emission control line is stopped, the fifth and fourth transistors M5 and M4 are turned on.

When the fourth transistor M4 is turned on, the first and second nodes N1 and N2 are electrically coupled to each other, and the voltage at each of the first and second nodes N1 and N2 is changed into the voltage Vdata of the data signal. More specifically, the voltage applied to the second node N2 during the previous period is charged across the storage capacitor Cst, but the voltage applied to the first node N1 is not charged across a separate capacitor. Therefore, when the fourth transistor M4 is turned on, the voltage at the first node N1 is changed into the voltage Vdata of the data signal.

When the fifth transistor M5 is turned on, the voltage of the first power source ELVDD is supplied to the third node N3. At this time, the first and second nodes N1 and N2 are set in a floating state, and therefore the storage capacitor Cst maintains the voltage charged during the previous period. When the voltage of the first power source ELVDD is supplied to the third node N3, the first transistor M1 controls the amount of current supplied to the OLED according to the voltage charged across the storage capacitor Cst.

Here, the voltage corresponding to the threshold voltage of the first transistor M1 is charged across the storage capacitor Cst. Therefore the current supplied to the OLED is determined regardless of the threshold voltage of the first transistor M1. In this embodiment, the voltage charged across the storage capacitor Cst is determined regardless of the voltage of the first power source ELVDD, and accordingly, an image with a desired luminance can be displayed regardless of the voltage drop of the first power source ELVDD.

Figure 5:
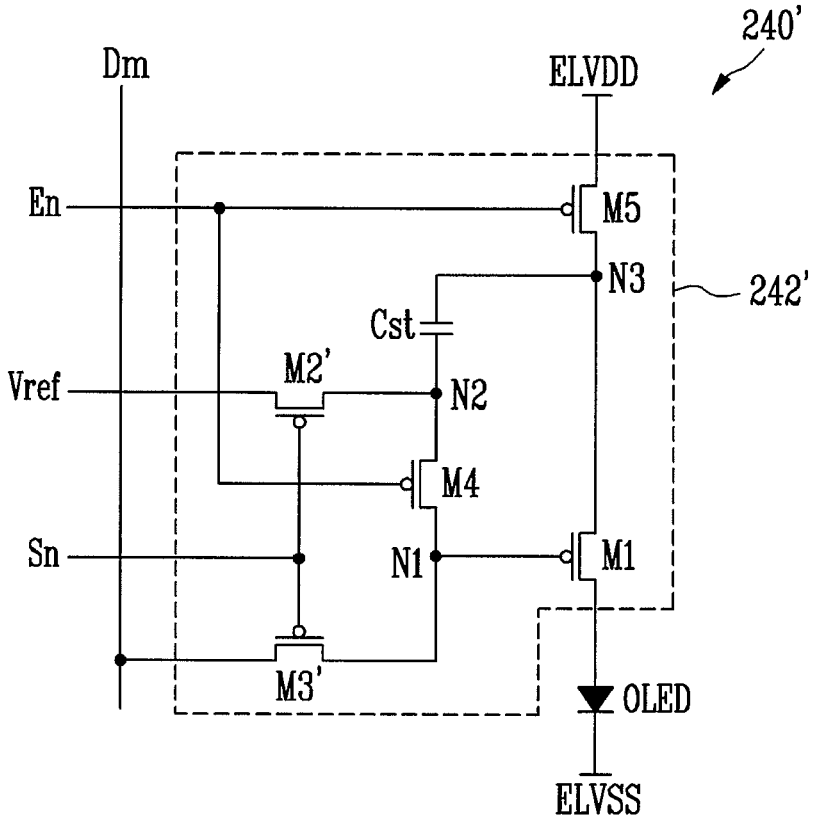
FIG. 5 is a circuit diagram showing another embodiment of a pixel shown in FIG. 2.

FIG. 5 is a circuit diagram showing another embodiment of the pixel shown in FIG. 2. In FIG. 5, components identical to those of FIG. 3 will be designated by like reference numerals, and their detailed descriptions will be omitted.

Referring to FIG. 5, the pixel 240' according to one embodiment of the present invention includes an OLED and a pixel circuit 242' for controlling an amount of current supplied to the OLED. The pixel 240' may be used in place of the pixel 240 in FIG. 2, for example.

A gate electrode of a second transistor M2' included in the pixel circuit 242' is coupled to the scan line Sn, and a first electrode of the second transistor M2' is coupled to the reference power source Vref. A second electrode of the second transistor M2' is coupled to the second node N2. When a scan signal is supplied to the scan line Sn, the second transistor M2' is turned on to supply the voltage of the reference power source Vref to the second node N2.

A gate electrode of a third transistor M3' is coupled to the scan line Sn, and a first electrode of the third transistor M3' is coupled to the data line Dm. A second electrode of the third transistor M3' is coupled to the first node N1. When the scan signal is supplied to the scan line Sn, the third transistor M3' is turned on to electrically couple the first node N1 and the data line Dm to each other.

The operation of the pixel 240' will be described in conjunction with FIGS. 4 and 5. First, a scan signal is supplied to the scan line Sn during a first period T1, and the second and third transistors M2' and M3' are turned on.

When the third transistor M3' is turned on, the first node N1 and the data line Dm are electrically coupled to each other. When the second transistor M2' is turned on, the voltage of the reference power source Vref is supplied to the second node N2. The voltage of the reference power source Vref, supplied to the second node N2, is supplied to the first node N1 via the fourth transistor M4. Accordingly, the voltage at the first node N1 is also set as the voltage of the reference power source Vref during the first period T1.

During a second period T2, an emission control signal is supplied to the emission control line En so that the fourth and fifth transistors M4 and M5 are turned off.

When the fourth transistor M4 is turned off, the first and second nodes N1 and N2 are electrically isolated from each other. At this time, the voltage at the first node N1 is set as the voltage Vdata of the data signal, and the voltage at the second node N2 is set as the voltage of the reference power source Vref.

When the fifth transistor M5 is turned off, the first power source ELVDD and the third node N3 are electrically isolated from each other. When the third node N3 is electrically isolated from the first power source ELVDD, the voltage at the third node N3 is dropped to the voltage obtained by adding the threshold voltage of the first transistor M1 to the voltage Vdata of the data signal. At this time, the voltage corresponding to the voltage of the data signal and the threshold voltage of the first transistor M1 is charged across the storage capacitor Cst.

During a third period T3, the supply of the scan signal is stopped so that the second and third transistors M2' and M3' are turned off. At this time, the voltage maintained during the second period T2 is maintained at the first, second and third nodes N1, N2 and N3.

During a fourth period T4, the supply of the emission control signal is stopped so that the fourth and fifth transistors M4 and M5 are turned on.

When the fourth transistor M4 is turned on, the first and second nodes N1 and N2 are electrically coupled to each other. At this time, the voltage at each of the first and second nodes N1 and N2 is changed to the voltage of the reference power source Vref. When the fifth transistor M5 is turned on, the voltage of the first power source ELVDD is supplied to the third node N3. At this time, the first and second nodes N1 and N2 are set in a floating state, and the storage capacitor Cst maintains the voltage charged during the previous period. When the voltage of the first power source ELVDD is supplied to the third node N3, the first transistor M1 controls the amount of current supplied to the OLED in accordance with the voltage charged in the storage capacitor Cst.

Figure 6:
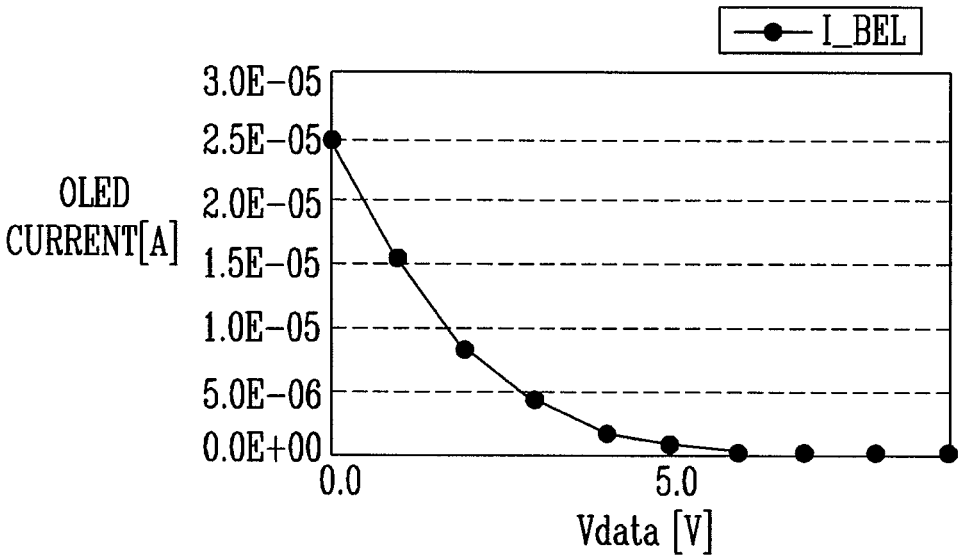
FIG. 6 is a graph showing current magnitudes based on data voltages of the embodiment of the pixel shown in FIG. 3.

FIG. 6 is a graph showing current magnitudes based on data voltages of the pixel 240 shown in FIG. 3.

Referring to FIG. 6, when a voltage of about 0V to about 5V (e.g. 0V to 5V) is applied as the voltage Vdata of the data signal, the amount of current that flows in the OLED is changed from about 0 μA to about 25 μA (e.g. 0 μA to 25 μA). That is, gray levels can be represented by applying a data signal with a voltage Vdata of about 0V to about 5V (e.g. 0V to 5V). Accordingly, low-voltage driving is possible.

While the present invention has been described in connection with certain exemplary embodiments, it is to be understood that the present invention is not limited to the disclosed embodiments, but, on the contrary, is intended to cover various modifications and arrangements included within the spirit and scope of the appended claims, and equivalents thereof.

What is claimed is:

1. A pixel circuit comprising:

an organic light emitting diode;

a first transistor having a second electrode coupled to the organic light emitting diode, the first transistor being configured to control an amount of current supplied to the organic light emitting diode;

a third transistor coupled between a reference power source and a first node, the first node being directly coupled to a gate electrode of the first transistor and also being directly coupled to the third transistor, the third transistor being configured to be turned on when a scan signal is supplied to a scan line;

a second transistor configured to be turned on when the scan signal is supplied to the scan line, the second transistor for electrically coupling a data line and a second node to each other such that a data signal on the data line is applied to the second node when the second transistor is turned on;

a fourth transistor coupled between the first node and the second node, the fourth transistor being configured to be turned off when an emission control signal is supplied to an emission control line;

a fifth transistor coupled between a first electrode of the first transistor and a first power source, the fifth transistor being configured to be turned off when the emission control signal is supplied to the emission control line; and a storage capacitor coupled between the second node and the first electrode of the first transistor.

2. The pixel circuit according to claim 1, wherein a turn-on time of the second transistor and a turn-on time of the fourth transistor partially overlap one another in time.

3. The pixel circuit according to claim 2, wherein the fourth transistor is configured to be turned off after the second transistor is turned on, and the fourth transistor is configured to be turned on after the second transistor is turned off.

4. An organic light emitting display device comprising:

a scan driver configured to supply a scan signal to scan lines and to supply an emission control signal to emission control lines;

a data driver configured to supply a data signal to data lines; and pixel circuits positioned at crossing regions of the scan lines and the data lines, wherein each of the pixel circuits comprises:

an organic light emitting diode;

a first transistor having a second electrode coupled to the organic light emitting diode, the first transistor being configured to control an amount of current supplied to the organic light emitting diode;

a third transistor configured to be turned on when the scan signal is supplied to a corresponding scan line of the scan lines, the third transistor for electrically coupling a first node that is directly coupled to a gate electrode of the first transistor to a reference power source;

a second transistor configured to be turned on when the scan signal is supplied to the corresponding scan line, the second transistor for electrically coupling a second node to a corresponding data line of the data lines such that the data signal on the data line is applied to the second node when the second transistor is turned on;

a fourth transistor coupled between the first node and the second node, the fourth transistor being configured to be turned off when the emission control signal is supplied to a corresponding emission control line of the emission control lines;

a fifth transistor coupled between a first electrode of the first transistor and a first power source, the fifth transistor being configured to be turned off when the emission control signal is supplied to the corresponding emission control line; and a storage capacitor coupled between the second node and the first electrode of the first transistor.

5. The organic light emitting display device according to claim 4, wherein the reference power source is configured to have a voltage between a first data signal of a black gray level and a second data signal of a white gray level.

6. The organic light emitting display device according to claim 4, wherein the scan driver is configured to supply the emission control signal to the corresponding emission control line so that the emission control signal overlaps in time with the scan signal supplied to the corresponding scan line during a first period.

7. The organic light emitting display device according to claim 6, wherein the scan driver is configured to supply the emission control signal to the corresponding emission control line after the scan signal is supplied to the corresponding scan line.

8. The organic light emitting device of claim 7 wherein the scan driver is configured to stop the supply of the emission control signal to the corresponding emission control line after the supply of the scan signal to the corresponding scan line is stopped.

9. The organic light emitting display device according to claim 6, wherein the data driver is configured to supply the data signal to the corresponding data line during a period in which the scan signal overlaps the emission control signal in time.

* * * * *